US010323307B2

(12) United States Patent
Ehrhardt et al.

(10) Patent No.: US 10,323,307 B2
(45) Date of Patent: Jun. 18, 2019

(54) PROCESS AND STEEL ALLOYS FOR MANUFACTURING HIGH STRENGTH STEEL COMPONENTS WITH SUPERIOR RIGIDITY AND ENERGY ABSORPTION

(71) Applicant: AM/NS Calvert LLC, Calvert, AL (US)

(72) Inventors: Bertram Wilhelm Ehrhardt, Mobile, AL (US); Ranbir Singh Jamwal, Mobile, AL (US)

(73) Assignee: AM/NS Calvert LLC, Calvert, AL (US)

( * ) Notice: Subject to any disclaimer, the term of this patent is extended or adjusted under 35 U.S.C. 154(b) by 944 days.

(21) Appl. No.: 14/802,482

(22) Filed: Jul. 17, 2015

(65) Prior Publication Data

US 2016/0017469 A1 Jan. 21, 2016

Related U.S. Application Data

(60) Provisional application No. 62/025,554, filed on Jul. 17, 2014.

(51) Int. Cl.

| | |
|---|---|
| ***C21D 8/02*** | (2006.01) |
| ***C22C 38/58*** | (2006.01) |
| ***C21D 8/00*** | (2006.01) |
| ***C21D 1/613*** | (2006.01) |
| ***C21D 6/00*** | (2006.01) |
| ***C22C 38/42*** | (2006.01) |
| ***C22C 38/34*** | (2006.01) |
| ***C22C 38/06*** | (2006.01) |

(52) U.S. Cl.

CPC ..... *C22C 38/58* (2013.01); *C21D 1/613* (2013.01); *C21D 6/004* (2013.01); *C21D 6/005* (2013.01); *C21D 6/008* (2013.01); *C21D 8/005* (2013.01); *C21D 8/02* (2013.01); *C22C 38/06* (2013.01); *C22C 38/34* (2013.01); *C22C 38/42* (2013.01)

(58) Field of Classification Search

CPC ..... C21D 8/005; C21D 8/02
USPC ..... 148/579, 648, 650–654
See application file for complete search history.

(56) References Cited

U.S. PATENT DOCUMENTS

2012/0118437 A1* 5/2012 Wang ..... B21D 22/022 148/512
2013/0295402 A1* 11/2013 Oh ..... C21D 1/18 428/551
2014/0030544 A1* 1/2014 Maki ..... C21D 1/673 428/632

OTHER PUBLICATIONS

F. Dieknnan, Cold and Cryogenic Treatment of Steel, Steel Heat Treating Fundamentals and Processes. vol. 4A, ASM Handbook, ASM International, 2013, p. 382-386. (Year: 2013).*

* cited by examiner

*Primary Examiner* — Brian D Walck
(74) *Attorney, Agent, or Firm* — Dinsmore & Shohl LLP

(57) ABSTRACT

A steel alloy and process for producing a hot formed component. The process includes providing a steel alloy sheet having a chemical composition (wt %) within a range of 0.3-0.85 C, 1.0-6.0 Mn, 1.0-4.0 Si+Al and the remainder being tramp elements and impurities. The steel alloy sheet is heated to within a temperature range between 700-900° C. for a time between 1-180 seconds and hot formed. Thereafter, the hot formed sheet is cooled to ambient temperature. Then, cooled hot formed sheet is tempered at a temperature between 200-600° C. for a time between 20-3000 seconds and cooled again to ambient temperature. The tempered and cooled sheet has a tensile strength between 1400-2400 MPa and at least 10% elongation to failure, and/or a product of (Continued)

tensile strength times percent elongation to failure of at least 16000 MPa·%.

20 Claims, 3 Drawing Sheets

PROCESS AND STEEL ALLOYS FOR MANUFACTURING HIGH STRENGTH STEEL COMPONENTS WITH SUPERIOR RIGIDITY AND ENERGY ABSORPTION

RELATED APPLICATION

The instant application claims priority of U.S. Provisional Application No. 62/025,554 filed on Jul. 17, 2014, the contents of which are incorporated herein in their entirety by reference.

FIELD OF THE INVENTION

The present invention is related to a high strength steel, and in particular, to a high strength steel for hot stamping.

BACKGROUND OF THE INVENTION

With ever-increasing demands for increased passenger safety and lightweight solutions in auto body structures, new steel grades for cold forming have been developed. Such steel grades, either as coated or uncoated steel strip, are cut or stamped into blanks which are cold stamped or cold hydro formed into a desired shape.

Steel grades used for cold forming have included micro alloyed high strength steels, dual phase steels, and multi-phase steels such as retained austenite bearing TRIP steels and complex phase steels. However, when such steels exceed tensile strengths of 800 megapascals (MPa), formability of such materials is insufficient to form complex parts. In addition, martensitic steels with tensile strengths between 1000 and 2000 MPa have also been used/tested, however, the martensitic steels have been susceptible to delayed cracking problems due to hydrogen embrittlement.

In order to overcome the above-stated deficiencies, boron steels are currently used to produce complex shapes. For example, boron steel blanks are first heated and then hot formed or press hardened into a complex shaped component, followed by cooling of the component within the forming die. It is appreciated that such processing typically occurs on hot forming lines that include a blank destacking device, a furnace for heating the blanks to a desired elevated temperature, a hydraulic press or servo press, and additional components that guarantee process control with respect to time, speed, and temperature.

It is also appreciated that the hot forming process includes heating the blanks to a temperature above the austenite transformation temperature for a given particular alloy to be hot formed. In addition, the blanks are hot formed within the austenitic range where formability is high. Thereafter, the formed component is cooled using a cooling rate that is sufficient to prevent formation of ferrite, pearlite, and/or bainite, thereby resulting in a microstructure of martensite with only a small amount of retained austenite. Heretofor resulting parts/components have tensile strengths between 1000-2000 MPa, but the percent elongation to failure has been between 5-11%, with a decrease in ductility with increasing tensile strength close to a limit in product of tensile strength times percent elongation to failure of 11000 MPa·%. Therefore, an improved process and steel alloy combination that provides for elevated tensile strengths in the range of 1400-2400 MPa and tensile elongations of at least 10% and/or up to a TS of 1600 MPa or for tensile strength above 16000 MPa a product of tensile strength times percent elongation to failure of at least 16000 MPa·%. would be a desirable goal.

A coupled hot stamping and heat treating process has recently been suggested to achieve such a goal. Such a coupled system would require a process line that affords for quenching a part to a defined temperature above ambient temperature and then transferring the part inside the one and the same process line into a second furnace without significant temperature loss. However, such a process line would require investment into new press hardening lines and not utilize existing technology. In addition, significant effort and costs would be required to synchronize and achieve desired throughput required for cost efficient press hardening lines. As such, an improved process and steel alloy combination that can produce a desired strength and ductility combination using existing process line technology would be desirable.

SUMMARY OF THE INVENTION

A steel alloy and process for producing a hot formed component from a high strength steel alloy using state of the art hot forming processing lines is provided. The process includes providing a steel alloy sheet having a chemical composition (wt %) within a range of 0.3-0.85 C, 1.0-6.0 Mn, 1.0-4.0 Si+Al and the remainder being tramp elements and impurities. The alloy obeys the relation 40° C.$\leq T_{\Delta} \leq$300° C. where $T_{\Delta}$=Ms−21° C., Ms is a martensite start temperature for the alloy, and Ms is defined by the relation Ms=539−423.C−30.4.Mn−17.7.Ni−12.1.Cr−7.5.Mo−10.Cu+30.Al. The steel alloy sheet is heated to within a temperature range between 700-900° C. for a time between 1-180 seconds and hot formed. Thereafter, the hot formed sheet is cooled to ambient temperature. Then, the cooled hot formed sheet is tempered at a temperature between 200-600° C. for a time between 20-3000 seconds and cooled again to ambient temperature.

The tempered and cooled sheet has a tensile strength between 1400-2400 MPa and at least 10% elongation to failure, and/or a product of tensile strength times percent elongation to failure of at least 16000 MPa·%.

In some instances, the steel alloy sheet has at least one of 0.0-1.0 Cr, 0.0-0.5 Mo, 0.0-2.0 Ni, 0.0-1.0 Cu, 0.0-0.10 Nb, 0.0-0.10 Ti, 0.0-0.01 B, 0.0-0.015 N, and 0.0-0.20 V. In addition to or in the alternative, the steel alloy sheet can have a C content between 0.3-0.8 C and be provided from hot band, i.e. hot rolled strip, that has a thickness of less than 7 mm and has been subsequently cold rolled more than 30% and annealed at temperatures below 850° C. in a continuous annealing line or below 700° C. in a batch annealing facility.

In other instances, the steel alloy sheet can be provided form hot band that has a thickness of less than 9 mm which is subsequently stamped or cut into blanks. The blanks are processed according to the process discussed above and the tempered and cooled blanks have a tensile strength between 1600-2400 MPa and at least 10% elongation to failure, and/or a product of tensile strength times percent elongation to failure of at least 16000 MPa·%.

In still other instances, the steel alloy sheet can be provided form hot band that has a thickness of less than 7 mm which is subsequently cold rolled more than 30% and which is stamped or cut into blanks. The blanks are processed according to the process discussed above and the tempered and cooled blanks have a tensile strength between 1600-2400 MPa and at least 10% elongation to failure, and/or a product of tensile strength times percent elongation to failure of at least 16000 MPa·%.

In still yet other instances, the steel alloy sheet can be provided from hot band that has a varying cold rolled thickness between 1.0 and less than 5 mm and which is subsequently stamped or cut into blanks with varying thickness. The blanks are processed according to the process discussed above and the tempered and cooled blanks have a tensile strength between 1600-2400 MPa and at least 10% elongation to failure, and/or a product of tensile strength times percent elongation to failure of at least 16000 MPa·%.

The hot formed sheet is quenched to ambient temperature at a cooling rate sufficient to avoid formation of ferrite, pearlite and bainite. In addition, the hot formed sheet can be quenched or cooled from a delta temperature TA below Martensite start temperature but above Martensite finish temperature to the ambient temperature

DETAILED DESCRIPTION OF THE INVENTION

Figure 1:
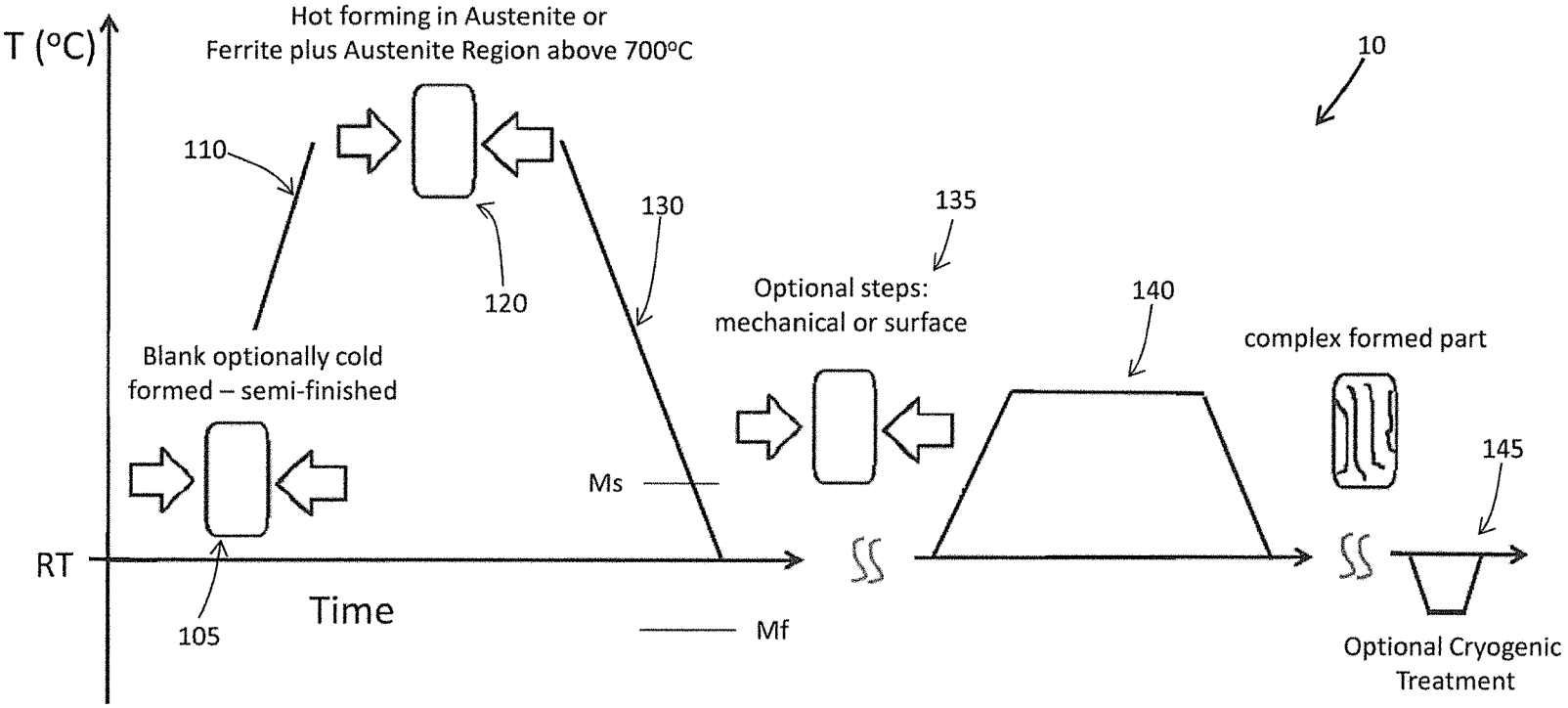
FIG. 1 is schematic illustration of a process according to one aspect of the invention disclosed herein.

A process and steel alloy combination that provides stamping blanks which can be stamped on existing hot stamping lines is provided. The new process and alloy allows for the stamping blanks to be hot stamped and then cooled to ambient temperature as is done in existing hot stamping lines. The stamped components can then be subjected to a heat treatment in a separate furnace facility and thus allows the hot stamping and heat treatment processes to be decoupled. Also, the inventive process and steel alloy combination allows for an additional cold forming or surface conditioning step to be included before a final tempering step is executed.

The process includes providing a steel blank with a chemical composition, in weight percent, within a range of 0.3-0.85 carbon (C), 1.0-6.0 manganese (Mn), and 1.0-4.0 silicon (Si) plus aluminum (Al). The steel blank is heated to an austenitic temperature range for the given alloy and for a time between 1-180 seconds. In some instances, the austenitic temperature range is between 700-900° C. In addition, ferrite may or may not be present at the austenitic temperature range. For example, up to 30 volume percent (vol %) of ferrite, with the remainder being austenite, can be present during the 1-180 seconds that the steel blank is heated to the austenitic range. The heated steel blank is hot formed within the austenitic temperature range and subsequently cooled at a cooling rate that is sufficient to avoid the formation of pearlite, and/or bainite to ambient temperature which is between Martensite Start Temperature (Ms) and Martensite Finish Temperature (Mf) for the alloy. In addition, the hot formed steel blank is quenched from annealing and forming temperature to ambient temperature, passing through Ms with a delta temperature ($T_\Delta$) drop of between 40 to 300° C. and is to 21° C. or approximately 21° C. (21+/−5° C.) ambient temperature. Stated differently, the following relations are obeyed:

$$T_\Delta = Ms - 21^\circ \text{ C. (for a given alloy)} \quad (1)$$

and $$40^\circ \text{ C.} \leq T_\Delta \leq 300^\circ \text{ C.} \quad (2)$$

Also, the Ms in degrees centigrade (° C.) is determined by the following relation with the elemental contents in wt %:

$$Ms = 539 - 423.C - 30.4.Mn - 17.7.Ni - 12.1.Cr - 7.5.Mo - 10.Cu + 30.Al. \quad (3)$$

By providing an alloy that allows for such processing, the material can be used to produce hot stamped components using existing state of the art hot stamping lines and future hot stamping lines with any rate of increased throughput production. It is appreciated that the cooled hot formed steel blank can be considered at a semi-finished stage or semi-finished component and thus can be stored for any time period before being finished with a final heat treatment. For example, the cooled hot formed steel blank can be subjected to a final temper within a temperature range of 200-600° C. for a time between 20-3000 seconds. In addition, the cooled hot formed steel blank can be subjected to one or more cold forming steps/operations before a final hot forming process step.

The inventive hot formed, cooled and tempered steel blank has a tensile strength (TS) between 1400-2400 MPa and a tensile elongation greater than 10% and/or a combination of tensile strength in MPa and total elongation in percentage (%) that exceeds 16000 MPa·%. For example, exemplary typical tensile strength and minimum total elongation values are shown in Table 1 below.

TABLE 1

| Tensile Strength (MPa) | Total Elongation (%) |
|---|---|
| 1480 | 10.8 |
| 1740 | 9.2 |
| 1870 | 8.6 |

In comparison, conventional martensitic structures provide only up to 10000 MPa·% when press hardening with typical tensile strength and total elongation values for prior art alloys and/or processes shown in Table 2 below.

TABLE 2

| Tensile Strength (MPa) | Total Elongation (%) |
|---|---|
| 980 | 10.2 |
| 1180 | 8.5 |
| 1740 | 6.8 |
| 1870 | 5.3 |

In some instances, the chemical composition of the steel blank includes one or more of the following chemical alloying additions: 0.0-1.0 chromium (Cr), 0.0-0.5 molybdenum (Mo), 0.0-2.0 nickel (Ni), 0.0-1.0 copper (Cu), 0.0-0.10 niobium (Nb), 0.0-0.10 titanium (Ti), 0.0-0.01 boron (B), 0.0-0.015 nitrogen (N), and 0.0-0.20 vanadium (V).

Not being bound by theory, Si is used to stabilize austenite during annealing and at room temperature since it increases the carbon activity in ferrite and austenite, and reduces the C solubility in ferrite. As such, Si retards the precipitation of cementite ($Fe_3C$) during tempering. In addition, Mn enhances hardenability and austenite stability.

The microstructure of a final part/component can be martensite plus interlath austenite, the austenite enriched with carbon during the temper step, also known as the partitioning step. Optionally equiaxed ferrite grains can be present from intercritical annealing or from cooling. Carbon precipitation is suppressed during final tempering in the presence of sufficient Si and/or Al and/or Si plus Al. In addition, with carbides not being formed, the C can diffuse from supersaturded martensite with a body centered cubic (BCC) structure into the austenite with a face centered cubic (FCC) structure and a higher solubility of carbon. It is appreciated that after the partitioning/tempering step, the martensite finish temperature is shifted well below ambient temperature. As such, the C enriched austenite can exhibit transformation induced work hardening and additionally twinning induced work hardening in a crash situation leading to higher energy absorbance compared to prior art martensitic steels of the same strength class, which is reflected in the higher product of TS·%.

Alloying elements such as Mo and Cr can be added to influence the partitioning kinetics of C through the interface between martensite and austenite. Also, microallying with Nb and Ti can be used for grain refinement, and B, Mn, Cr and/or Mo can be added to increase hardenability. In addition to Si and/or Al, Cu and Ni can be used to suppress carbide precipitation. Furthermore, with the increase in C, Mn and Ni aid in reducing the austentite to ferrite transformation temperature such that hot forming with high austenite volume fraction at temperatures as low as 700° C. is achieved.

Microalloying elements such as Nb, Ti or V can be used for a refined austenite grain size during the annealing step and for retarding recrystallization after hot forming which can refine further the resulting final microstructure.

The inventive process can use conventional existing process lines of the steel industry for strip manufacturing. In addition, strip is cut or stamped into a plurality of blanks as is known to those skilled in the art. The blanks are heated within the alloy's austenitic range, e.g. between 700-900° C., and then formed within the austenitic range in a forming press or other forming tool. The formed component is then quenched to ambient temperature with a delta temperature $T_\Delta$ which results in the ambient temperature being below the martensite start temperature, but above the martensite finish temperature for the alloy. Table 3 below gives examples for suitable inventive alloy and prior art alloy compositions (wt %) and the respective difference of Ms−21° C. ($T_\Delta$).

TABLE 3

| | Ms (° C.) | Ms − 21° C. | C | Mn | Si | Cr | Al | Ni | Cu |
|---|---|---|---|---|---|---|---|---|---|
| Prior Art Alloy | 352 | 331 | 0.3 | 2 | 2 | 0.2 | 0.1 | 0.001 | 0.001 |
| Inventive Alloy | 310 | 289 | 0.4 | 2 | 2 | 0.2 | 0.1 | 0.001 | 0.001 |
| Inventive Alloy | 267 | 246 | 0.5 | 2 | 2 | 0.2 | 0.1 | 0.001 | 0.001 |
| Inventive Alloy | 225 | 204 | 0.6 | 2 | 2 | 0.2 | 0.1 | 0.001 | 0.001 |
| Inventive Alloy | 183 | 162 | 0.7 | 2 | 2 | 0.2 | 0.1 | 0.001 | 0.001 |
| Inventive Alloy | 140 | 119 | 0.8 | 2 | 2 | 0.2 | 0.1 | 0.001 | 0.001 |
| Inventive Alloy | 321 | 300 | 0.3 | 3 | 2 | 0.2 | 0.1 | 0.001 | 0.001 |
| Inventive Alloy | 279 | 258 | 0.4 | 3 | 2 | 0.2 | 0.1 | 0.001 | 0.001 |
| Inventive Alloy | 237 | 216 | 0.5 | 3 | 2 | 0.2 | 0.1 | 0.001 | 0.001 |

TABLE 3-continued

| | Ms (° C.) | Ms − 21° C. | C | Mn | Si | Cr | Al | Ni | Cu |
|---|---|---|---|---|---|---|---|---|---|
| Inventive Alloy | 195 | 174 | 0.6 | 3 | 2 | 0.2 | 0.1 | 0.001 | 0.001 |
| Inventive Alloy | 152 | 131 | 0.7 | 3 | 2 | 0.2 | 0.1 | 0.001 | 0.001 |
| Inventive Alloy | 110 | 89 | 0.8 | 3 | 2 | 0.2 | 0.1 | 0.001 | 0.001 |
| Inventive Alloy | 269 | 248 | 0.3 | 4 | 2 | 0.5 | 0.1 | 0.8 | 0.4 |
| Inventive Alloy | 227 | 206 | 0.4 | 4 | 2 | 0.5 | 0.1 | 0.8 | 0.4 |
| Inventive Alloy | 185 | 164 | 0.5 | 4 | 2 | 0.5 | 0.1 | 0.8 | 0.4 |
| Inventive Alloy | 142 | 121 | 0.6 | 4 | 2 | 0.5 | 0.1 | 0.8 | 0.4 |
| Inventive Alloy | 100 | 79 | 0.7 | 4 | 2 | 0.5 | 0.1 | 0.8 | 0.4 |
| Prior Art Alloy | 58 | 37 | 0.8 | 4 | 2 | 0.5 | 0.1 | 0.8 | 0.4 |

The quenched component is reheated in a subsequent tempering step from ambient temperature to a temperature suitable for partitioning of carbon from martensite into retained austenite. Such a temperature can be between 200-600° C. In addition, the resulting part has more than 10% total elongation to failure and a tensile strength between 1400-2400 MPa and/or a combination of tensile strength in MPa and total elongation in percentage (%) exceeding 16000 MPa·%.

It is appreciated that the steel can be calcium (Ca) treated for inclusion control, or in the alternative treated in another method/fashion to produce inclusion controlled steel. Also, finished components may or may not be weldable with non weldable versions joined to other structures of an automotive body or other machine via mechanical joining processing, fasteners, etc.

It is appreciated that in prior art steels and processes, the supersaturated C in martensite leads to $Fe_3C$ precipitation. However, the high Si content with or without support of other non-carbide forming elements such as Al, Cu or Ni of the inventive alloys disclosed herein prevents $Fe_3C$ formation and the excess C in the martensite is partitioned to the austenite. As such, carbon-enriched austenite is retained down to ambient temperature and the processed alloy has a final microstructure of martensite with retained austenite, which is additionally enriched with carbon, but not leading to carbide precipitation, in a tempering step. In some instances, some ferrite is present also.

In one embodiment, a suitable alloy with between 0.3-0.8 C is processed to hot band of less than 7 millimeter (mm) thickness. The hot band has a ferritic and/or pearlitic microstructure that exhibits good cold rolling and pickling related properties. For example, the hot band can be pickled and subjected to more than 30% cold rolling/reduction in thickness and annealed at temperatures below 850° C. in a continuous annealing line or below 700° C. in a box annealing facility.

The material may or may not be coated in a continuous strip steel processing line with resulting ferritic/pearlitic microstructures sufficient for blanking. Finally, blanks of the alloy are processed into a structural component using the process disclosed above and have a tensile strength above 1400 MPa and a tensile elongation of at least 10% and/or a product of tensile strength and percent total elongation to failure of at least 16000 MPa·%.

In another embodiment, a suitable alloy with between 0.3-0.8 C is processed to hot band of less than 4 mm thickness having a ferritic and/or perlitic microstructure, or in the alternative a completely pearlitic microstructure or in a further alternative a bainitic/martensitic microstructure that is subsequently pickled in a pickling line. The resulting pickled hot band is then blanked and the blanks processed using the inventive process described above to produce structural components with a tensile strength above 1600

MPa and at least 10% elongation to failure and/or a product of tensile strength and total percent elongation to failure of at least 16000 MPa·%.

In yet another embodiment, a coated steel blank from a suitable alloy having between 0.3-0.45 C is heated to above 820° C., i.e. within the fully austenitic range of the material. In some instances, the coated steel material has a metal coating with a high melting point such as an aluminum-silicon coating. The blank is press formed after sufficient time at the prescribed austenitic temperatures for austenization of the material. After the steel blank has been hot formed, it is quenched or at least sufficiently cooled to avoid ferrite, pearlite and/or bainite from $T_\Delta$ to ambient temperature within a forming die with or without subsequent final cooling in air. In the alternative, the formed component is quenched within an oil or water bath. The final tempering step includes holding the formed component between 200-600° C. for a time between 20-3000 seconds.

In still yet another embodiment of the present invention, a coated steel blank with between 0.5-0.8 C is processed by heating above 700° C., i.e. such that it is within the austenitic range. The blank is then press formed at a prescribed austenitic temperature after sufficient time within the austenitic range, e.g. between 1-180 seconds. The formed part is quenched or at least sufficiently cooled to avoid ferrite, pearlite and/or bainite to ambient temperature with a delta temperature $T_\Delta$ below Ms but above Mf to the ambient temperature. The part can be cooled within the forming die itself or by placing within an oil or water bath. After cooling to ambient temperature range, the formed component is transferred with or without intermediate storage to a tempering step in another furnace where it is held between 200-600° C. for a time between 20-3000 seconds.

Turning now to FIG. 1, a schematic illustration of a process according to an embodiment of the invention is shown generally at reference numeral 10. The process includes providing a steel blank, coated or uncoated, with a chemical composition within the range discussed above at step and heating the blank to within the austenitic or ferrite plus austenite temperature range above 700° C. for a given alloy being processed at step 110. It is appreciated that the steel blank can be optionally cold formed or semi-finished at step 105 prior to heating of the steel blank above 700° C. After heating within the austenitic or ferrite plus austenite range above 700° C. for a predetermined amount of time, the heated steel blank is hot formed at step 120 and then cooled at a sufficient cooling rate at step 130 such that ferrite, pearlite and/or bainite are avoided in the microstructure of the steel to ambient temperature with a delta temperature TA resulting in ambient temperature being below Ms but above Mf. For example, the steel blank can be quenched to Ms with a cooling rate representing at least air cooling of a 9 mm thick part and up to 1000 K/s depending on the critical cooling rate of the alloy. Further cooling from Ms to ambient temperature in the temperature interval of $T_\Delta$ can be performed at any cooling but preferred not with less cooling rate than represented by air cooling of a 12 mm thick part.

The quenched steel component can be subjected to a tempering treatment where it is held at a temperature range between 200-600° C. for a time between 20-3000 seconds at step 140. In this manner, diffusion of hydrogen can occur such that delayed cracking due to hydrogen embrittlement in the presence of martensite is reduced or prevented. In addition, the tempering step provides more ductility to the material which is then less prone to brittle delayed fracture. Not being bound by theory, the increased ductility is achieved by diffusion of C from the oversaturated martensite into the austenite, thereby stabilizing the retained austenite. In the alternative, bainitic ferrite can grow during tempering and partitioning of C into the retained austenite can occur with the same effect. It is appreciated that optional processing steps such as additional mechanical forming, surface treatment and the like can be performed at step 135 before the tempering treatment at step 140 and an optional cryogenic treatment with minimum temperature of −200 deg C. can be performed at step 145 after the tempering treatment at step 140.

Figure 2:
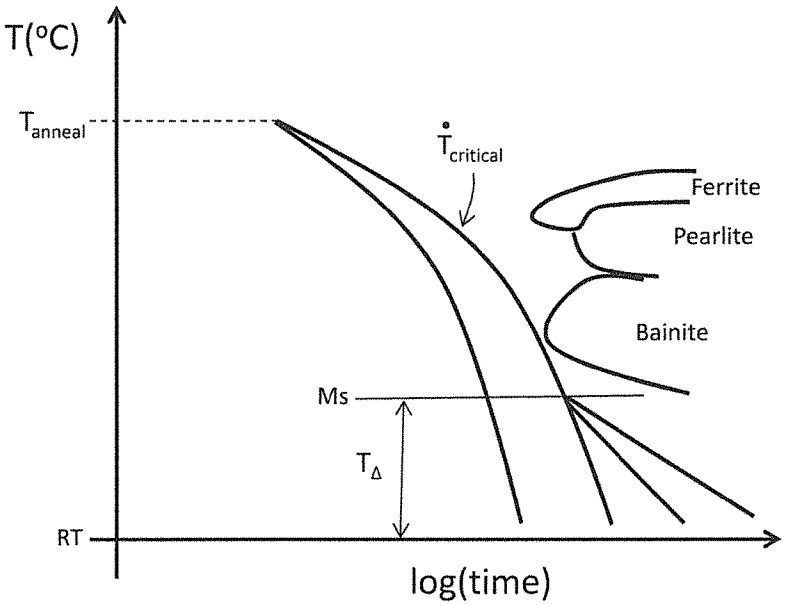
FIG. 2 is a schematic illustration of a Continuous Cooling Transformation (CCT) diagram for the inventive alloys disclosed herein.

FIG. 2 provides a graphical representation of temperature versus log time and the cooling rate(s) necessary to avoid the formation of ferrite, pearlite and bainite for the inventive alloys disclosed herein. It is appreciated that such graphs are known as Continuous Cooling Transformation (CCT) diagrams to those skilled in the art. The critical cooling rate ($\dot{T}_{critical}$) shown in the figure represents the slowest continuous cooling rate required to avoid a "nose", i.e. the formation, of ferrite, pearlite and bainite phases. Stated differently, any cooling rate that is greater that the critical cooling rate will result in the austenite microstructure obtained during annealing to be present until the alloy reaches Ms. Thereafter, only martensite will form with the possibility of retained austenite being present. In addition, after the alloy or component has been cooled to Ms, the cooling rate can be reduced but no ferrite, pearlite or bainite will form and only the amount of retained austenite may be effected by differences in carbon partitioning already during the cooling phase.

Figure 3A:
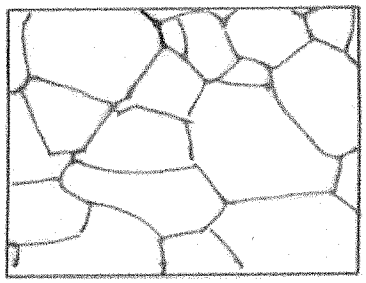
FIG. 3A is a schematic illustration of a representative microstructure for an inventive alloy during an annealing treatment according to an aspect disclosed herein.
Figure 3B:
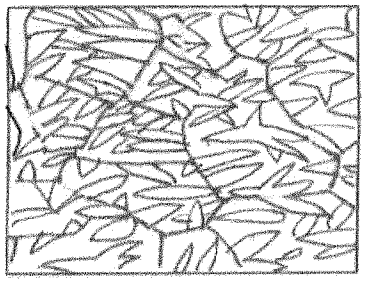
FIG. 3B is a schematic illustration of a representative microstructure for an inventive alloy after quenching from TA to ambient temperature according to an aspect disclosed herein.
Figure 3C:
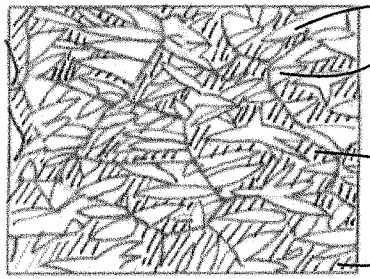
FIG. 3C is a schematic illustration of a representative microstructure for an inventive alloy after a tempering treatment according to an aspect disclosed herein.

Representative microstructures for the steel during the inventive process are shown in FIG. 3. In particular, FIG. 3A represents the microstructure of the steel blank while within the temperature range of 700-900° C., the microstructure having mostly if not entirely austentite grains with C in solution. FIG. 3B represents the microstructure of the steel blank after being quenched from the annealing temperature to ambient temperature which is $T_\Delta$ below Ms, the microstructure having mostly if not entirely C in solution in retained austenite and oversaturated C in ferritic martensitic. Finally, FIG. 3C represents the microstructure of the steel blank after tempering within the temperature range of 200-600° C., the microstructure having mostly if not entirely austenite grains with C enrichment and martensitic ferrite It is appreciated that the resulting microstructure of carbide free fine structured ferrite, mostly lath type martensitic ferrite, and C enriched finely dispersed inter lath retained austenite exhibits the desired favorable mechanical properties at the final part.

Figure 4:
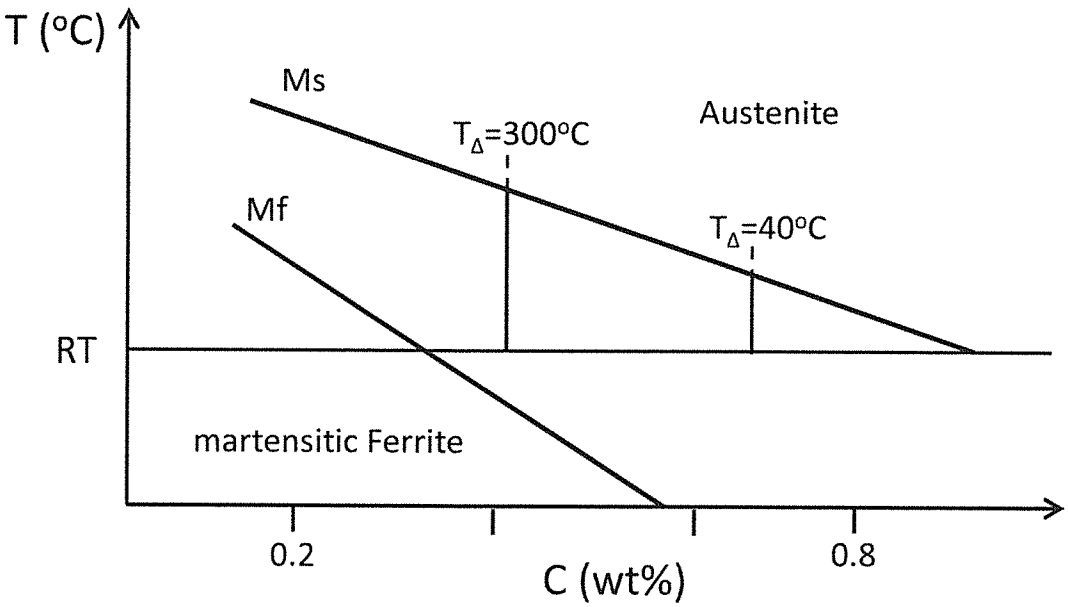
FIG. 4 is a graphical representation of temperature versus carbon concentration illustrating transformation temperature of austenite to martensite for inventive alloys disclosed herein.

Turning now to FIG. 4, a graph illustrating transformation temperature of austenite to martensite for the inventive alloys is shown. In particular, Ms and Mf temperatures are shown as a function of C content in the alloys. In addition, room or ambient temperature (RT) is shown on the graph, e.g. 21° C. As shown in the figure, a steel alloy have a $T_\Delta$ of 300° C. and a steel alloy having a $T_\Delta$ of 40° C. can be quenched to ambient temperature with different ratios of martensitic ferrite:austentite present. For example, the alloy having $T_\Delta$=300° C. and quenched to RT would have a martensitic ferrite:austenite ratio of 90:10 before tempering, whereas the alloy having $T_\Delta$=40° C. and quenched to RT would have a martensitic ferrite:austenite ratio of 60:40 before tempering. In this manner an alloy can be selected to produce hot formed components using existing hot stamping process lines.

In addition to the above, a coil with a composition within the above disclosed range can be optionally soft annealed, for example using a standard industrial box annealing process, to make the material more suitable for cold forming before going to the final hot forming operation and subsequent process to achieve the desired microstructure.

Furthermore, a formed component can be subjected to cryogenic treatment in order to obtain a final microstructure that is equivalent to the lowest likely service temperature of a vehicle, for example a cryogenic treatment of −20° C. As such, crash behavior changes from an original body structure manufactured at room temperature, and due to additional martensite formation during cold temperature operation/service of the vehicle, can be avoided. A cryogenic treatment can increase strength and is an additional optional step, illustratively including immersing the formed component into liquid nitrogen which has a liquidus temperature of at −196° C. (~200° C.).

In further addition to the above, the semi-finished parts can be subjected to an additional mechanical or surface conditioning before final tempering is done.

It is appreciated that changes, modifications, etc. to the teachings above can be made and yet fall within the scope of the invention. As such, the specification should be interpreted broadly.

We claim:

1. A process for producing a hot formed component from a high strength steel alloy, the process comprising:

providing a steel alloy sheet having a chemical composition (wt %) within a range of 0.3-0.85 C, 1.0-6.0 Mn, 1.0-4.0 Si+Al and the remainder being iron and tramp elements and impurities, the alloy obeying the relation 40° C.≤Ms−21° C.≤300° C. where Ms is a martensite start temperature for the alloy and is defined by the relation:

$$Ms=539-423\bullet C-30.4\bullet Mn-17.7\bullet Ni-12.1\bullet Cr-7.5\bullet Mo-10\bullet Cu+30\bullet Al$$

where C, Mn, Ni, Cr, Mo, Cu and Al are the elemental concentrations (wt %) in the alloy;

heating the steel alloy sheet to within a temperature range between 700−900° C. for a time between 1-180 seconds;

hot forming the sheet within the temperature range between 700−900° C.;

cooling the hot formed sheet to ambient temperature;

tempering the cooled hot formed sheet at a temperature between 200-600° C. for a time between 20-3000 seconds;

cooling the tempered sheet to ambient temperature;

the tempered and cooled sheet having at least one of the following properties selected from the group consisting of: (a) a tensile strength between 1400-2400 MPa and at least 10% elongation to failure; and (b) a product of tensile strength times percent elongation to failure of at least 16000 MPa•%.

2. The process of claim 1, wherein the chemical composition of the steel alloy sheet has at least one of 0.0-1.0 Cr, 0.0-0.5 Mo, 0.0-2.0 Ni, 0.0-1.0 Cu, 0.0-0.10 Nb, 0.0-0.10 Ti, 0.0-0.01 B, 0.0-0.015 N, and 0.0-0.20 V.

3. The process of claim 1, wherein the steel alloy sheet has between 0.3-0.8 C.

4. The process of claim 3, wherein the provided steel alloy sheet is provided from hot rolled band having a thickness of less than 7 mm that has been subjected to more than 30% cold rolling and annealed at temperatures below 850° C. in a continuous annealing line.

5. The process of claim 3, wherein the provided steel alloy sheet is provided from hot rolled band having a thickness of less than 7 mm that has been subjected to more than 30% cold rolling and annealed at temperatures below 700° C. in a box annealing facility.

6. The process of claim 3, wherein the provided steel alloy sheet is provided form hot rolled band having a thickness of less than 4 mm and the tempered and cooled sheet has at least one of the following properties selected from the group consisting of: (a) a tensile strength between 1600-2400 MPa and at least 10% elongation to failure; and (b) a product of tensile strength times percent elongation to failure of at least 16000 MPa·%.

7. The process of claim 1, wherein the steel alloy sheet has between 0.3-0.45 C.

8. The process of claim 7, wherein the steel alloy sheet is heated to within a temperature range between 820-900° C. for the time between 1-180 seconds.

9. The process of claim 1, wherein the steel alloy sheet has between 0.5-0.85 C.

10. The process of claim 1, wherein the hot formed sheet cooled to ambient temperature is cooled at a cooling rate sufficient to avoid formation of ferrite, pearlite and bainite.

11. The process of claim 10, wherein the hot formed sheet cooled to ambient temperature is cooled $T_A$ relative to the Ms temperature for the alloy.

12. The process of claim 1, further including cryogenically treating the tempered and cooled sheet to a temperature of less than −200° C.

13. The process of claim 12, wherein the tempered and cooled sheet is placed in contact with liquid nitrogen.

14. A process for producing a hot formed component from a high strength steel alloy, the process comprising:

providing a steel alloy sheet from hot band having a thickness less than 7 mm and a chemical composition (wt %) within a range of 0.3-0.85 C, 1.0-6.0 Mn, 1.0-4.0 Si+Al and the remainder being iron and tramp elements and impurities, the alloy obeying the relation 40° C.≤Ms−21° C.≤300° C. where Ms is a martensite start temperature for the alloy and is defined by the relation:

$$Ms=539-423.C-30.4.Mn-17.7.Ni-12.1.Cr-7.5.Mo-10.Cu+30.Al$$

where C, Mn, Ni, Cr, Mo, Cu and Al are the elemental concentrations (wt %) in the alloy;

cold rolling the hot band more than 30%;

annealing the cold rolled steel alloy sheet at temperatures below 850° C. in a continuous annealing line or at temperatures below 700° C. in a box annealing facility;

heating the annealed cold rolled steel alloy sheet to within a temperature range between 700-900° C. for a time between 1-180 seconds;

hot forming the sheet within the temperature range between 700-900° C.;

cooling the hot formed sheet to ambient temperature at a cooling rate sufficient to avoid formation of ferrite, pearlite and bainite;

tempering the cooled hot formed sheet at a temperature between 200-600° C. for a time between 20-3000 seconds;

cooling the tempered sheet to ambient temperature;

the tempered and cooled sheet having at least one of the following properties selected from the group consisting of: (a) a tensile strength between 1400-2400 MPa and at least 10% elongation to failure; and (b) a product of tensile strength times percent elongation to failure of at least 16000 MPa·%.

15. The process of claim 14, wherein the hot band has a thickness less than 4 mm.

16. The process of claim 14, wherein steel alloy sheet has between 0.3-0.45 C and the annealed cold rolled steel alloy sheet is heated to within a temperature range between 820-900° C. for a time between 1-180 seconds and hot formed within the temperature range of 820-900° C.

17. The process of claim 14, wherein the hot formed sheet cooled to ambient temperature is cooled $T_{\Delta}$ relative to the Ms temperature.

18. The process of claim 14, further including cryogenically treating the tempered and cooled sheet to a temperature of less than −200° C.

19. The process of claim 18, wherein the tempered and cooled sheet is placed in contact with liquid nitrogen.

20. The process of claim 14, claim 1, wherein the chemical composition of the steel alloy sheet has at least one of 0.0-1.0 Cr, 0.0-0.5 Mo, 0.0-2.0 Ni, 0.0-1.0 Cu, 0.0-0.10 Nb, 0.0-0.10 Ti, 0.0-0.01 B, 0.0-0.015 N, and 0.0-0.20 V.

* * * * *